US009683357B2

(12) United States Patent
Provencher

(10) Patent No.: US 9,683,357 B2
(45) Date of Patent: Jun. 20, 2017

(54) SYSTEM AND METHOD FOR INSTALLING AN UNDERMOUNT SINK

(71) Applicant: Jeffrey M Provencher, Port Orange, FL (US)

(72) Inventor: Jeffrey M Provencher, Port Orange, FL (US)

( * ) Notice: Subject to any disclaimer, the term of this patent is extended or adjusted under 35 U.S.C. 154(b) by 86 days.

(21) Appl. No.: 14/803,730

(22) Filed: Jul. 20, 2015

(65) Prior Publication Data

US 2016/0032574 A1 Feb. 4, 2016

Related U.S. Application Data

(60) Provisional application No. 62/026,253, filed on Jul. 18, 2014.

(51) Int. Cl.
*E03C 1/33* (2006.01)

(52) U.S. Cl.
CPC ..... *E03C 1/335* (2013.01)

(58) Field of Classification Search
CPC ..... E03C 1/335; E03C 1/33
USPC ..... 4/631–635, 648, 649; 248/201, 312.1, 248/298.1
See application file for complete search history.

(56) References Cited

U.S. PATENT DOCUMENTS 59,572 A * 11/1866 Ewing ..... E03C 1/33 4/649
260,871 A * 7/1882 Hyde ..... E03C 1/33 280/779
569,268 A * 10/1896 Willmet ..... E03C 1/33 4/649
591,664 A * 10/1897 Badanes ..... E03C 1/322 248/235
597,503 A * 1/1898 Lanahan ..... E03C 1/33 4/649
653,986 A * 7/1900 Conderman ..... E03C 1/322 248/235
2,035,301 A * 3/1936 Daugherty ..... E03C 1/324 248/201
4,613,995 A 9/1986 Ricke
5,743,501 A 4/1998 Rapp
6,530,097 B1 3/2003 Sung
7,429,021 B2 * 9/2008 Sather ..... E03C 1/33 248/200.1
8,070,562 B1 12/2011 Murrer
(Continued)

FOREIGN PATENT DOCUMENTS

EP 1092811 A2 * 4/2001 ..... E03C 1/33

OTHER PUBLICATIONS

E-Z Sink Bracket Installation Sheet; https://ezsinkbracket.com/downloads.aspx; Jul. 8, 2014.

*Primary Examiner* — Erin Deery
(74) *Attorney, Agent, or Firm* — Christopher M. Ramsey; GrayRobinson, P.A.

(57) ABSTRACT

An undermount sink mounting system includes a support member adapted to engage a frame onto which a countertop is mounted. The support member upwardly supports a sink engagement lever, which is adapted to engage a sink in such a way that said sink engagement lever presses the sink upwardly toward the countertop when the sink is mounted. A height adjustment member is adapted to move the sink engagement lever upwardly to engage the sink and adjust how forcefully said sink engagement lever presses against the sink.

16 Claims, 6 Drawing Sheets

(56) References Cited

U.S. PATENT DOCUMENTS

| | | | | |
|---|---|---|---|---|
| 8,794,577 | B2 * | 8/2014 | Laera | E03C 1/33<br>248/146 |
| 2012/0261533 | A1 | 10/2012 | Laera | |

* cited by examiner

SYSTEM AND METHOD FOR INSTALLING AN UNDERMOUNT SINK

CROSS-REFERENCE TO RELATED APPLICATION

This application claims the benefit of provisional Application No. 62/026,253, filed Jul. 18, 2014, which is hereby incorporated by reference in its entirety.

BACKGROUND

Conventional techniques for installing undermount sinks on cabinets, vanities, or the like are often unsightly, time consuming, labor intensive, and/or unstable. Many do not allow for the sink to be adjusted during installation or for the sink to be easily removed when necessary.

BRIEF SUMMARY

What is needed is a stable and adjustable system for installing an undermount sink that reduces the amount of labor involved in the installation, but also provides a stable support for the sink. My sink mounting system solves this problem by including a lever adapted to engage the flange of the sink in such a way that a first end the lever presses the flange upwardly toward the countertop when the sink is mounted while a second end of the lever engages the underside of the countertop so that the lever pivots about a fulcrum between the first end and said second end.

DETAILED DESCRIPTION OF PREFERRED EMBODIMENTS

Figure 1:
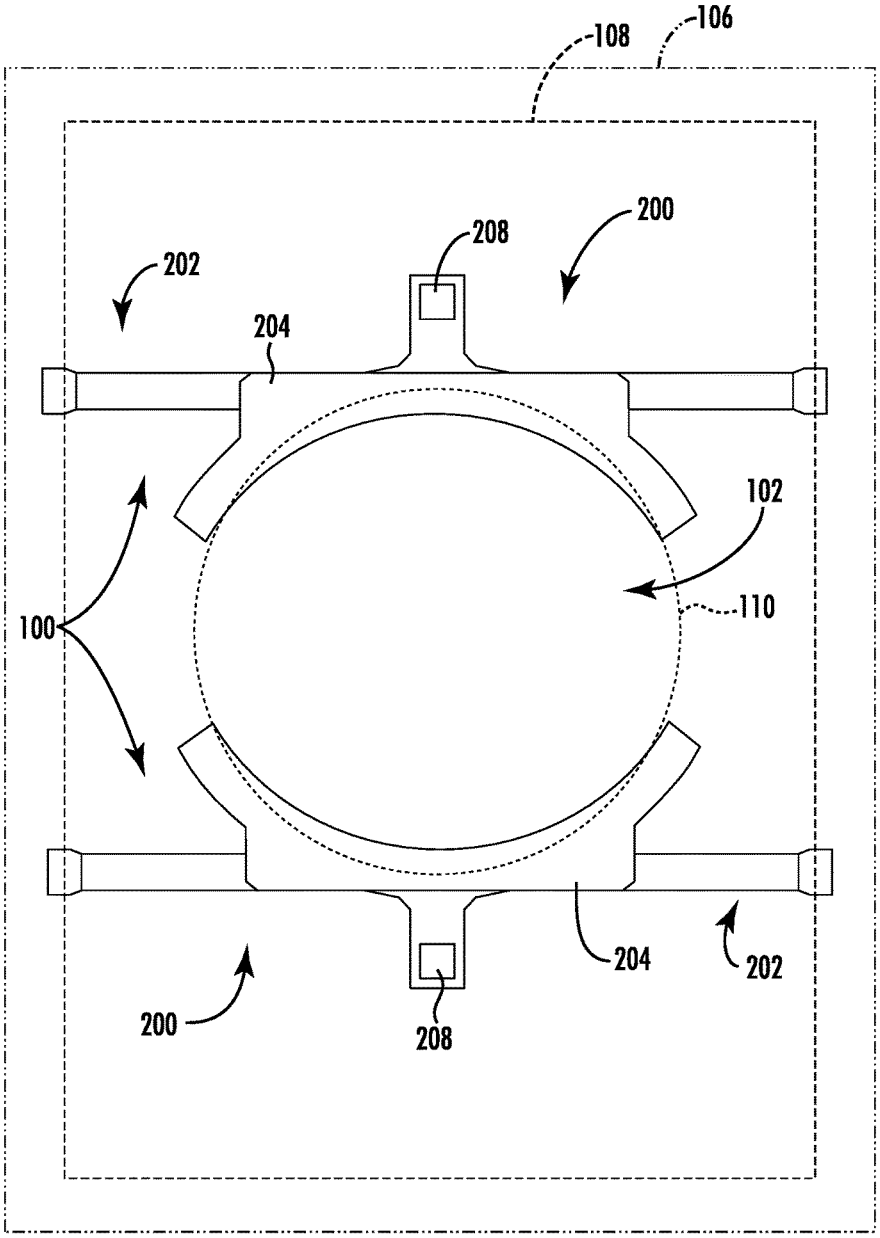
FIG. 1 is a top view of a sink mounting system in use.
Figure 2:
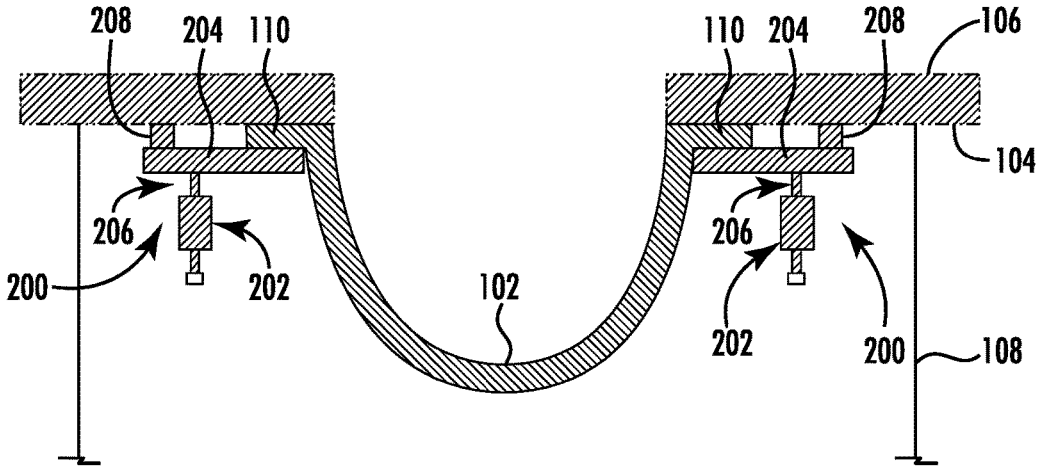
FIG. 2 is a side cutaway view of the sink mounting system in use.
Figure 3:
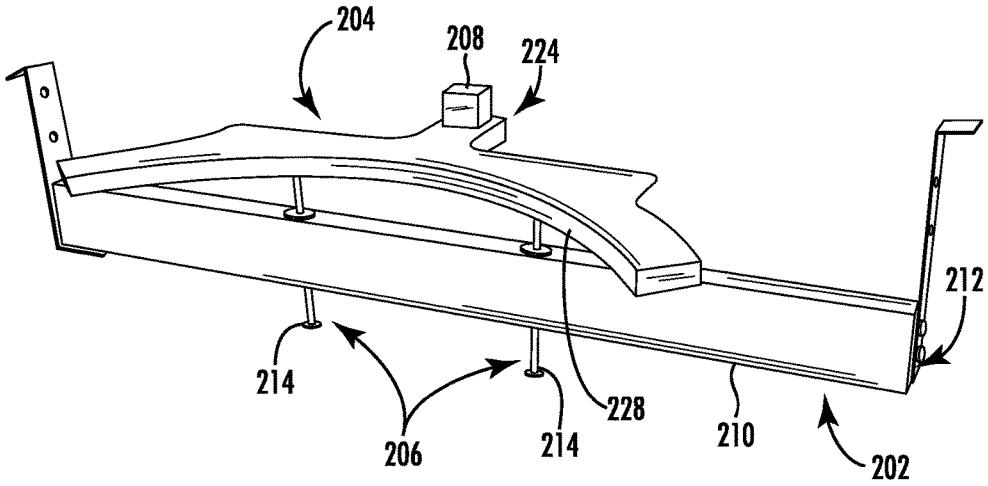
FIG. 3 is a top perspective view of a sink mounting member.

FIGS. 1 and 2 show an exemplary embodiment of the sink mounting system 100 in use to support a sink 102 on the bottom side 104 of a countertop 106. This type of sink 102 is conventionally referred to as an undermount sink. The structure to which the sink is mounted typically includes a frame 108, such as a cabinet or vanity. The sink 102 is generally bowl shaped and includes a top surrounding flange 110 extending laterally outwardly from the top edge of the sink 102.

Details of the sink mounting system 100 are now described with reference to FIGS. 1-10. The sink mounting system 100 includes a pair of sink mounting members 200 arranged on opposed sides of the sink 102.

A sink mounting member 200 includes a support member 202 configured to engage the frame 108 onto which the countertop 106 is located. The support member 202 upwardly supports a sink engagement lever 204. The sink engagement lever 204 is adapted to engage the flange 110 in such a way that the sink engagement lever 204 presses the flange 110 upwardly toward the countertop 106 when the sink 102 is mounted.

The sink mounting member 200 also includes a height adjustment member 206, which is adapted to move the sink engagement lever 204 upwardly to engage the flange 110 and adjust how forcefully the sink engagement lever 204 presses against the flange 110.

The sink mounting member 200 further includes a countertop engagement member 208 that engages with the bottom side 104 of the countertop 106 when the sink mounting member 200 is installed for use.

The support member 202 includes an elongate beam 210 having opposed ends 212, each with a mounting bracket 213 attached thereto for affixing the support member 202 to the frame 108. The elongate direction of the beam 210 may be fixed as shown or it may be adjustable.

The support member 202 also includes the height adjustment member 206. In the embodiment shown, the height adjustment member 206 includes a pair of threaded fasteners 214 that feed through respective openings 216 in the beam 210. At least a portion of the interior of the openings 216 is threaded with mating threads 218. The threads may be integrated into the beam or provided by using a threaded adapter 220 attached to the beam as shown in the example.

The sink engagement lever 204 includes a first end 222 that engages the flange 110, a second end 224 that engages the bottom side 104 of the countertop 106, and a fulcrum F between the first end 222 and said second end 224.

The first end 224 includes a sink receiving area 228 that is shaped to substantially approximate or mimic the shape of the sink 102. In the embodiment shown, the sink receiving area 228 is arcuately shaped to receive a circular or oval-shaped sink 102. The sink receiving area 228 may be adapted to take on many different shapes besides this, depending on the shape of the sink 102 to be installed. The shape of the sink receiving area is chosen so that the sink's flange 110 sits atop the first end 222. Accordingly, the first end 222 functions as a seat onto which the sink 102 is placed.

The second end 224 is laterally spaced apart from the first end 222 so that the fulcrum F is located therebetween. The countertop engagement member 208 is positioned at the second end 224 and has a top surface 230 that is vertically offset from the first end 222.

The height adjustment member 206 is substantially positioned at the fulcrum F and is adapted to move the sink engagement lever 204 upwardly to engage the flange 110 and adjust how forcefully the sink engagement lever 204 presses against the flange 110. In order to move the sink engagement lever 204 upwardly or downwardly, the threaded fasteners 214 are adjusted accordingly.

Figure 4:
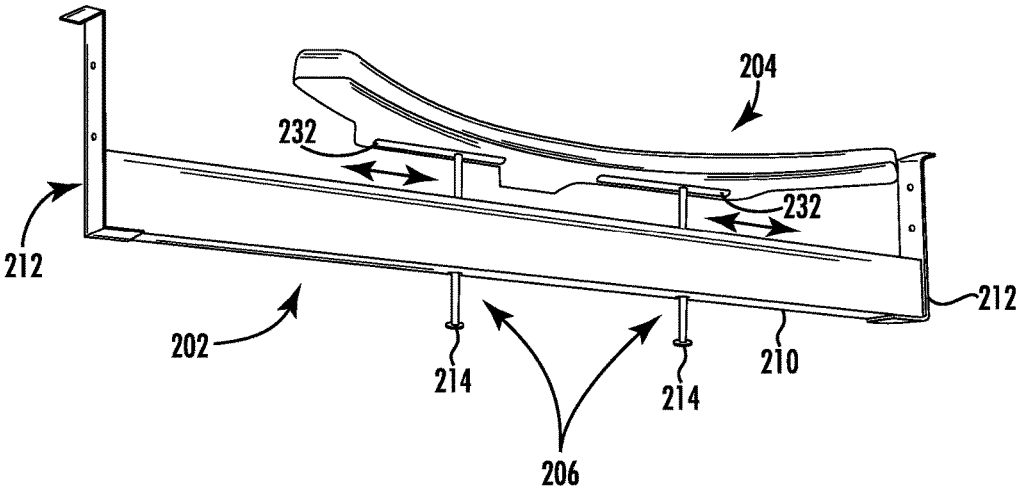
FIG. 4 is a bottom perspective view of the sink mounting member.
Figure 5:
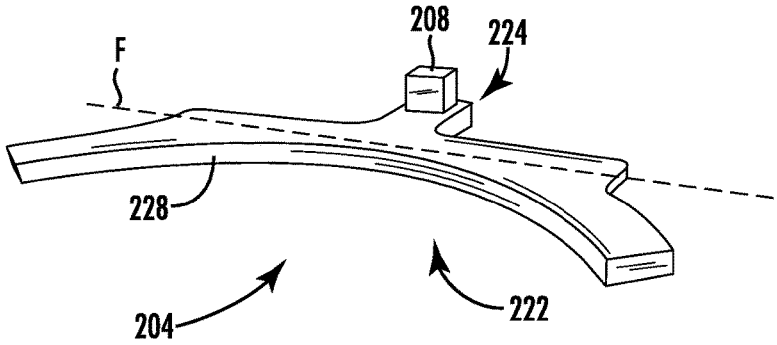
FIG. 5 is a top perspective view of a sink engagement lever.
Figure 6:
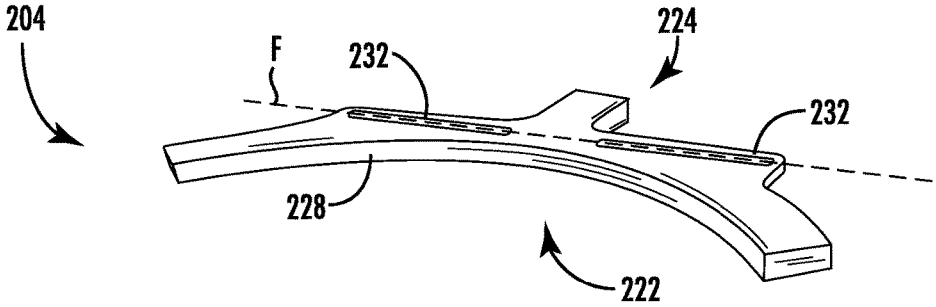
FIG. 6 is bottom perspective view of the sink engagement lever.
Figure 7:
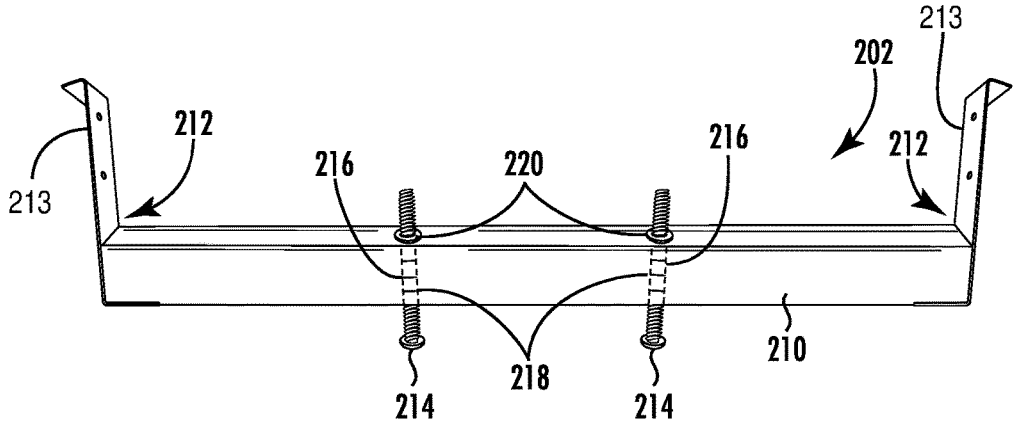
FIG. 7 is a top perspective view of a support member.
Figure 8:
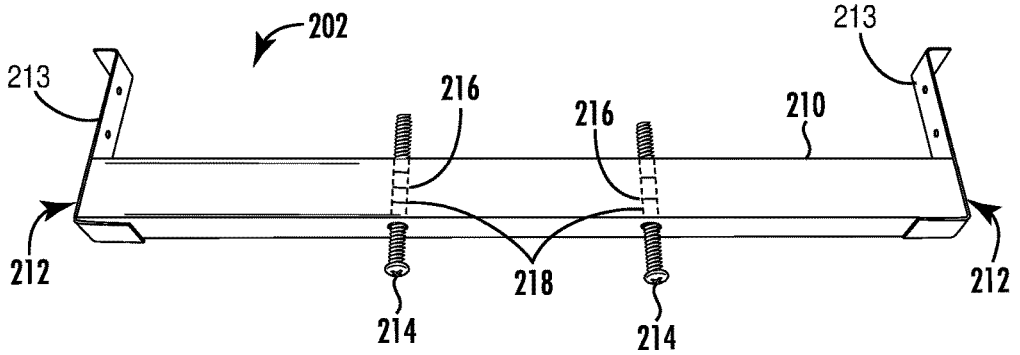
FIG. 8 is a bottom perspective view of the support member.

The lateral position of the sink engagement lever 204 is also adjustable, as indicated by the arrows in FIG. 4 because the upper end of the threaded fasteners are positioned within respective channels 232 formed in the bottom of the sink engagement lever 204. A user may adjust the lateral position of the sink engagement lever 204 by moving it along the channels 232.

Figure 9:
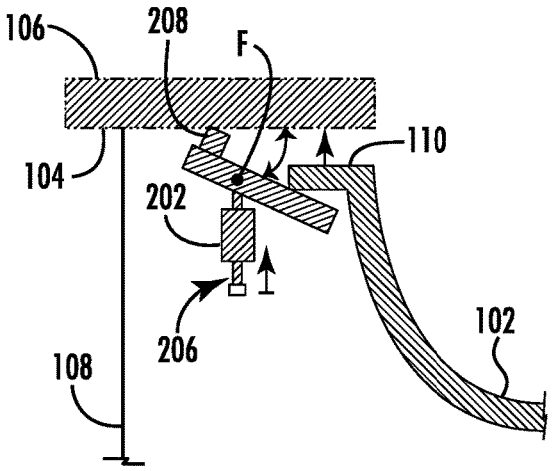
FIG. 9 is a side cutaway view of the sink mounting member being installed.
Figure 10:
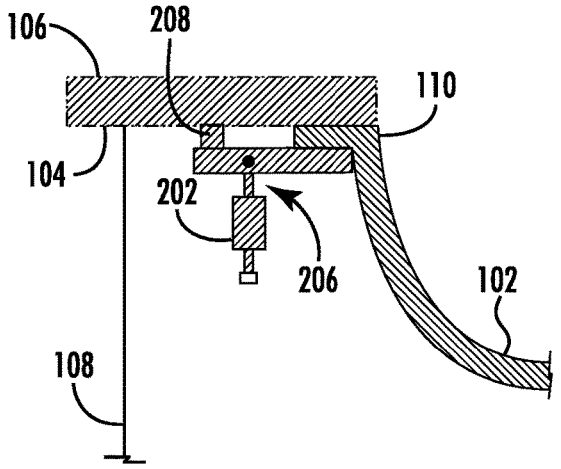
FIG. 10 is a side cutaway view of the sink mounting member installed.

FIGS. 9 and 10 illustrate the advantageous lever mechanism by which the sink mounting member 200 secures the sink 102 to the countertop 106. In FIG. 9, the support member 202 is affixed to the frame (not shown). The flange 110 of the sink 102 is placed atop the first end 222 of the sink engagement lever 204 whereas the countertop engagement member 208 is placed to engage the bottom 104 of the countertop 104. The height adjustment member 206 is then adjusted upwardly, pressing the countertop engagement member 208 against the countertop, which causes the sink engagement lever 204 to pivot about the fulcrum F. As it pivots, the sink engagement lever 204 lifts the sink 102 so as to make the sink flange 110 press against the countertop as shown in FIG. 10.

The sink mounting member 200 may be made of conventional materials such as plastic, metal, wood, or the like. The size and shape of the sink mounting member 200 may be adapted to meet the needs of the particular installation, type of sink, type of countertop, or type of frame.

An exemplary method of mounting a sink 102 to the bottom side 104 of a countertop 106 includes attaching the support member 202 to the frame 108 onto which the countertop 106 is mounted. This may be achieved using the brackets on the opposed ends 212 of the beam 210 or by conventional means such as nails, screws, adhesives, or the like. The method continues by moving the sink engagement lever 204 upwardly to engage the flange 110 by manipulating the height adjustment member 206 positioned at the fulcrum F.

The system and methods described above may be embodied in many different forms other than those discussed above and shown in the drawings. The embodiments shown and discussed are provided by way of example only.

That which is claimed is:

1. A system for mounting a sink to the underside of a countertop, the system comprising:

a support member connectable to a frame on which the countertop is positioned;

a sink engagement lever upwardly supported by the support member, the sink engagement lever having (a) a first end configured to contact the sink, (b) a second end configured to contact the underside of the countertop when the sink is mounted, and (c) a fulcrum positioned between the first end and second end, the sink engagement lever being able to pivot about the fulcrum; and a height adjustment member directly attached to the support member and contacting the sink engagement lever in such a way that the height adjustment member can raise the sink engagement lever relative to the support member.

2. The system of claim 1, wherein the support member includes an elongated beam having a pair of opposed ends, each of the opposed ends having a mounting bracket for affixing the support member to the frame.

3. The system of claim 1, wherein the sink engagement lever has a curved section with an arm extending from the curved section.

4. The system of claim 1, wherein the first end of the sink engagement lever is arcuately shaped for mimicking a curvature of the sink.

5. The system of claim 1, wherein the second end of the sink engagement lever is positioned higher than the first end when the sink engagement lever is oriented such that first end and second end are horizontal.

6. The system of claim 1, wherein the height adjustment member is positioned at the fulcrum.

7. The system of claim 1, wherein the height adjustment member includes at least one threaded fastener received within a channel formed in the sink engagement lever and the threaded fastener is slidable laterally within the channel.

8. The system of claim 1, wherein:

the support member includes an elongated beam having a pair of opposed ends, each of the opposed ends having a mounting bracket for affixing the support member to the frame;

the first end of the sink engagement lever is arcuately shaped for mimicking a curvature of the sink;

the second end of the sink engagement lever is positioned higher than the first end when the sink engagement lever is oriented such that first end and second end are horizontal;

the height adjustment member is positioned at the fulcrum; and the height adjustment member includes at least one threaded fastener received within a channel formed in the sink engagement lever and the threaded fastener is slidable laterally within the channel.

9. A sink mounting apparatus comprising:

a support member including an elongated beam and at least one mounting bracket for affixing the support member to a frame;

a sink engagement lever upwardly supported by the support member, the sink engagement lever having (a) a first end for contacting a sink, (b) a second end for contacting a countertop, and (c) a fulcrum positioned between the first end and second end, the sink engagement lever being able to pivot about the fulcrum; and a height adjustment member attached to the support member and contacting the sink engagement lever in such a way that the height adjustment member can raise the sink engagement lever relative to the support member.

10. The apparatus of claim 9, wherein the sink engagement lever has a curved section with an arm extending from the curved section.

11. The apparatus of claim 9, wherein the first end of the sink engagement lever is arcuately shaped for mimicking a curvature of a sink.

12. The apparatus of claim 9, wherein the second end of the sink engagement lever is positioned higher than the first end when the sink engagement lever is oriented such that first end and second end are horizontal.

13. The apparatus of claim 9, wherein the height adjustment member is positioned at the fulcrum.

14. The apparatus of claim 9, wherein the height adjustment member includes at least one threaded fastener received within a channel formed in the sink engagement lever and the threaded fastener is slidable laterally within the channel.

15. The apparatus of claim 9, wherein the height adjustment member includes a pair of threaded fasteners threaded though the support member and the threaded fasteners are positioned at the fulcrum.

16. The apparatus of claim 9, wherein:

the first end of the sink engagement lever is arcuately shaped for mimicking a curvature of the sink;

the second end of the sink engagement lever is positioned higher than the first end when the sink engagement lever is oriented such that the first end and second end are horizontal;

the height adjustment member is positioned at the fulcrum; and the height adjustment member includes at least one threaded fastener received within a channel formed in the sink engagement lever and the threaded fastener is slidable laterally within the channel.

* * * * *